US009978498B2

(12) United States Patent
Nakatsu et al.

(10) Patent No.: US 9,978,498 B2
(45) Date of Patent: May 22, 2018

(54) RESIN-MOLDED CORE AND REACTOR USING THE SAME

(71) Applicant: TAMURA CORPORATION, Tokyo (JP)

(72) Inventors: Ryo Nakatsu, Sakado (JP); Toshikazu Ninomiya, Sakado (JP); Kensuke Maeno, Sakado (JP)

(73) Assignee: TAMURA CORPORATION (JP)

( * ) Notice: Subject to any disclaimer, the term of this patent is extended or adjusted under 35 U.S.C. 154(b) by 25 days.

(21) Appl. No.: 15/131,890

(22) Filed: Apr. 18, 2016

(65) Prior Publication Data

US 2016/0233015 A1 Aug. 11, 2016

Related U.S. Application Data

(62) Division of application No. 14/448,749, filed on Jul. 31, 2014, now Pat. No. 9,343,221.

(30) Foreign Application Priority Data

Aug. 4, 2013 (JP) ..... 2013-161927

(51) Int. Cl.
*H01F 27/29* (2006.01)
*H01F 27/30* (2006.01)
(Continued)

(52) U.S. Cl.
CPC ..... *H01F 27/24* (2013.01); *H01F 27/263* (2013.01); *H01F 27/2823* (2013.01);
(Continued)

(58) Field of Classification Search
CPC ..... H01F 27/24; H01F 27/2828; H01F 27/29; H01F 27/263; H01F 27/306;
(Continued)

(56) References Cited

U.S. PATENT DOCUMENTS

2012/0194311 A1 8/2012 Suzuki
2013/0293335 A1* 11/2013 Yoshikawa ..... H01F 27/02 336/192
(Continued)

FOREIGN PATENT DOCUMENTS

JP H08162339 6/1996
JP 2004-095570 A * 3/2004
(Continued)

OTHER PUBLICATIONS

Office Action dated Jun. 23, 2015 for Japan Application No. 2013-161927 with English language translation (6 pages).

*Primary Examiner* — Mangtin Lian

(57) ABSTRACT

A resin-mold core includes right and left leg portions, and a yoke portion interconnecting those. The resin-mold core includes a magnetic core, and a mold component having the magnetic core embedded therein by molding. Openings where the magnetic core in the mold component is exposed are formed in multiple faces of the mold component that are upper, lower, front, rear, and right and left faces. A part of the yoke portion of the resin-mold core corresponding to a location where terminals are drawn to the exterior of the core from coils attached to the outer circumferences of the leg portions of the core has no opening formed in the multiple faces of the mold component. Positioning members to coaxially align the leg portions of the opposing resin-mold core are formed in abutting faces of the leg portions of the resin-mold core.

8 Claims, 10 Drawing Sheets

(51) Int. Cl.

| | |
|---|---|
| ***H01F 27/24*** | (2006.01) |
| ***H01F 27/26*** | (2006.01) |
| ***H01F 37/00*** | (2006.01) |
| ***H01F 27/28*** | (2006.01) |
| *H01F 41/02* | (2006.01) |

(52) U.S. Cl.
CPC ..... *H01F 27/29* (2013.01); *H01F 27/306* (2013.01); *H01F 37/00* (2013.01); *H01F 41/0246* (2013.01)

(58) Field of Classification Search
CPC .. H01F 27/2823; H01F 27/2847; H01F 37/00; H01F 41/0246; H01F 5/02; H01F 2005/025; H01F 2005/043
USPC ..... 336/198, 208, 192, 212
See application file for complete search history.

(56) References Cited

U.S. PATENT DOCUMENTS

| | | | | |
|---|---|---|---|---|
| 2013/0314964 | A1 | 11/2013 | Yoshikawa | |
| 2014/0218152 | A1 | 8/2014 | Ueno et al. | |
| 2014/0293655 | A1* | 10/2014 | Inaba ..... | H01F 27/255 363/15 |

FOREIGN PATENT DOCUMENTS

| | | |
|---|---|---|
| JP | 2007180140 | 7/2007 |
| JP | 2010-238798 | 10/2010 |
| JP | 2012043959 | 3/2012 |
| JP | 2013-012643 | 1/2013 |
| JP | 2013-149868 | 8/2013 |
| JP | 2013-149869 | 8/2013 |
| WO | WO 2006/016554 | 2/2006 |
| WO | WO2012/114890 | 8/2012 |
| WO | WO2013/001593 | 1/2013 |

* cited by examiner

RESIN-MOLDED CORE AND REACTOR USING THE SAME

CROSS-REFERENCE TO RELATED APPLICATIONS

This application is a divisional of U.S. patent application Ser. No. 14/448,749, filed on Jul. 31, 2014 and is based upon and claims the benefit of priority from Japanese Patent Application NO. 2013-161927, filed on Aug. 4, 2013; the entire contents of which are incorporated herein by reference.

BACKGROUND OF THE INVENTION

Field of the Invention

The present disclosure relates to a resin-mold core having a magnetic core embedded in a resin-mold component by molding like insert molding, and a reactor using the same.

Description of the Related Art

As a reactor utilized for, for example, an in-vehicle booster circuit, one which has a resin bobbin disposed at a leg portion of an annular magnetic core, and which has a coil wound around this bobbin is conventionally known. According to this type of reactor, as a technology of disposing the bobbin around the magnetic core, insert molding of the magnetic core in the resin bobbin is known.

In this case, not only the leg portion of the magnetic core is covered by the bobbin, but also the yoke portion of the magnetic core is covered by the resin integral with the bobbin in order to ensure the insulation of the yoke portion. A core having the leg portion and the yoke portion having undergone insert molding in the resin integral with the bobbin is generally called a resin-mold core, and disclosed in, for example, JP2013-149869 A, JP2013-149868 A, JP2013-012643 A and JP2010-238798 A.

When manufacturing the resin-mold core, a resin is filled around the magnetic core set in a die and is cured. At this time, it is necessary to support and lift up the magnetic core in the die so as to form a space around the magnetic core where the resin is filled. Hence, a protrusion (also called a spacer) that is a support member is provided at a part of the die, and the surface of the magnetic core is caused to contact the protrusion, and the magnetic core is supported in this way in the die.

According to a resin-mold core 100 obtained thus way, for example, as illustrated in FIG. 15, a portion corresponding to the protrusion of the die in an external resin-mold component 101 becomes an opening 102 where no resin is filled, and exposes a magnetic core 103 in the resin-mold component 101. In this case, in order to position the magnetic core at the center of the die, it is preferable to provide the protrusions around the entire circumference of the magnetic core, i.e., six surfaces which are the upper and lower, front and rear, and right and left surfaces of the magnetic core 103 from the standpoint of precise positioning. According to the conventional technology, the openings 102 are formed in all six surfaces of the resin-mold core.

When a reactor is manufactured using this type of resin-mold core, coils wound beforehand in a cylindrical shape are fitted to outer circumferences of respective leg portions 104 of the resin-mold core, and a terminal to connect the coil to an external wiring is connected to an end of each coil. In this case, since the connection terminals are connected to both ends of the coil, the terminal is typically drawn to the exterior through the yoke-portion side of the resin-mold core.

According to the conventional resin-mold core, the openings 102 are formed in all six surfaces of the resin-mold component 101. Accordingly, the opening 102 is also provided on a resin portion 109 covering the yoke portion, and the magnetic core 103 is exposed. Hence, when the terminal is drawn to the yoke-portion side from the end of the coil, it is difficult to ensure the insulation because of the opening 102 formed at the yoke portion. As a result, it is necessary to dispose the terminal so as to avoid the opening 102, and to provide another member that insulates the magnetic core 103 exposed at the opening 102 from the terminal.

When, however, the terminal is disposed so as to avoid the opening 102, the drawing direction of the terminal is restricted, and the downsizing of the reactor becomes difficult. In addition, when another insulation member is provided, the number of components of the reactor increases, and the number of assembling steps thereof increases.

The present disclosure has been made in order to address the above-explained problems of the conventional technology. It is an objective of the present disclosure to provide a resin-mold core which has no opening where a magnetic core is exposed at a yoke portion corresponding to a terminal drawing location, and which ensures an excellent insulation performance between the magnetic core and the terminal at the yoke portion.

It is another objective of the present disclosure to provide a reactor which uses the above-explained resin-mold core with an excellent insulation performance to improve the degree of freedom for a terminal drawing direction, and to reduce the number of components, thus enabling downsizing.

SUMMARY OF THE INVENTION

An aspect of the present invention provides a resin-mold core comprises: a magnetic core having a plurality of leg portions and a yoke portion which connects the leg portions; a resin-mold component inside of which the magnetic core is embedded by mold-forming and having a plurality of leg portions and a yoke portion which connects the leg portions; and openings exposing the magnetic core inside of the resin-mold component, the openings being formed on plural surfaces of the resin-mold component except a portion of the yoke portion of the resin-mold component through which a terminal connected to a coil to be mounted around the leg portions is drawn to exterior.

According to the present invention, "the magnetic core" means a core body embedded in the resin-mold component by molding. "The resin-mold core" means an integral body of the magnetic core and the resin-mold component.

Another aspect of the present invention provides a reactor in which coils are mounted around the leg portions of the resin-mold core having the above structure.

In one aspect of the present invention, a fastener extending an axial direction of the leg portion may be provided on the surface of the yoke portion. The terminal is fastened to the yoke portion by engaging the fastener to a part of the terminal and then sliding the terminal in the axial direction of the leg portions.

In one aspect of the present invention, the terminal is embedded in a resin-made terminal stage, and the terminal stage is disposed at the yoke portion of the resin-mold core so as to fix the terminal stage to the resin-mold component and connecting the terminal embedded in the terminal stage by molding to an end portion of the coils.

The terminal stage may covers the surface of the yoke portion from above of the yoke portion and may be fixed to the yoke portion by using a fixing member such as a screw-fixing, an engagement, a crimping or a joint member.

In this case, the terminal stage of one member may be prepared and covers partially or all of the two opposing yoke portions in the annular resin-mold core and the two coils mounted around the right and left leg portions, and four terminals connected to both end portions of each of the coils may be embedded in the one terminal stage by mold-forming.

Upon embedding the terminal in the terminal stage by mold-forming, a part of the terminal attached to the terminal stage may be lifted up upwardly, and an end portion of the coil protruding similarly upwardly may be connected to the lifted-up part of the terminal.

Upon fixing the terminal stage to the resin-mold core, a handle for carrying the reactor may be integrally formed on the part of the terminal stage by resin-forming.

Two U-shaped divisional cores having right and left leg portions and a yoke portion connecting the right and left leg portions are abutted to each other at end portions of the right and left leg portions respectively so as to form an annular core, and the right and left leg portions and the yoke portions of the two U-shaped divisional cores are respectively embedded inside of the resin-mold component by mold-forming. Accordingly, the resin-mode core may be formed. In this case, positioning members, such as a protrusion and a recess, are formed in abutting faces of the leg portions of the two divisional cores in the resin-mold component so as to coaxially align the leg portions of the resin-mold core opposed to each other.

According to the present disclosure, the openings exposing the magnetic core are not provided in the yoke portion of the resin-mold core. Hence, even if a terminal is disposed on this part, a sufficient insulation between the terminal and the magnetic core is ensured. As a result, it becomes possible to draw the terminal to the exterior from the yoke portion near the coil end, thereby enabling downsizing of the reactor.

In particular, when resin-made terminal stage having the terminal molded is disposed at this part, and the terminal stage and the resin portion of the resin-mold core are fastened, the fastening work of the terminal stage to the resin-mold core and a joining work of the terminal to the coil end can be carried out easily.

DETAILED DESCRIPTION OF THE EMBODIMENTS

1. First Embodiment

A first embodiment of the present disclosure will be explained in detail below with reference to FIGS. 1 and 2.

(1) Structure

Figure 1:
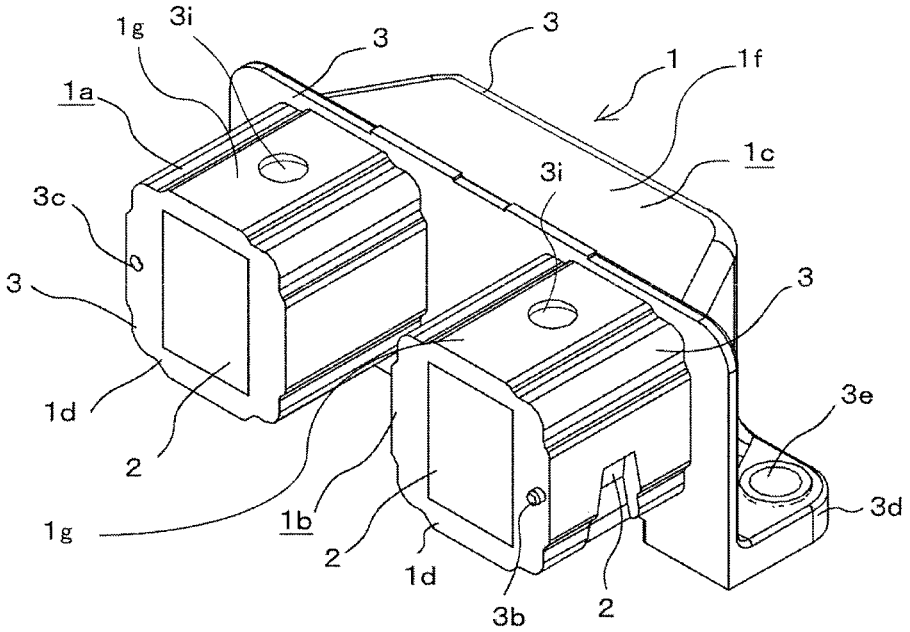
FIG. 1 is a perspective view of a resin-mold core according to a first embodiment.

As illustrated in FIG. 1, a resin-mold core 1 of this embodiment is formed in a U-shape having right and left leg portions 1*a*, 1*b* each formed in a rectangular column shape, and a trapezoidal yoke portion 1*c* connecting those. When a reactor is formed using this U-shaped resin-mold core 1, as illustrated in FIG. 2, end faces 1*d* of the respective leg portions 1*a*, 1*b* of the two U-shaped resin-mold cores 1 are abutted with spacers 1*e* to form an annular core. The U-shaped resin-mold cores 1 in FIG. 1 correspond to a "resin-mold core divided into two pieces" in appended claims.

The U-shaped resin-mold core 1 includes a magnetic core 2 likewise formed in a U-shape, and a resin-mold component (hereinafter, referred to as a mold component) 3 provided so as to cover the entire circumference of the magnetic core 2. The magnetic core 2 includes leg portions 2*a*, 2*b* and a yoke portion 2*c* connecting the leg portions 2*a*, 2*b* with each other. The magnetic core 2 is embedded in the mold component 3 by molding like insert molding, and end faces 2*d* of the U-shaped magnetic core 2 are exposed at the end faces 1*d* of the leg portions 1*a*, 1*b* of the U-shaped resin-mold core 1.

Openings 3*a* formed by protrusions that support the magnetic core 2 in a die at the time of molding are provided in the front and rear, right and left, and lower surfaces of the mold component 3. The openings 3*a* expose the surfaces of the magnetic core 2 embedded in the mold component 3. Conversely, no such opening 3*a* is provided in the upper surface of the mold component 3, and the whole upper surface of the magnetic core 2 is covered by the mold component 3.

There is no opening in the upper surfaces 1*g*, 1*g* of the leg portions 1*a*, 1*b* and the upper surface 1*f* of the yoke portion 1*c* in the U-shaped resin-mold core 1, and the upper surface of the magnetic core 2 is insulated by the resin-made mold component 3. When a reactor is formed using this resin-mold core 1, coils are attached to the outer circumferences of the leg portions 1*a*, 1*b*, and a terminal that is a thin plate connected to the coil end is drawn to the exterior of the reactor through the upper surface 1*f* of the yoke portion 1*c*. At this time, the upper surface 1*f* of the yoke portion 1*c* of the mold component 3 where no opening 3*a* is provided, ensures the insulation between the magnetic core 2 in the mold component and the terminal disposed on the yoke portion 1*c*.

Figure 2:
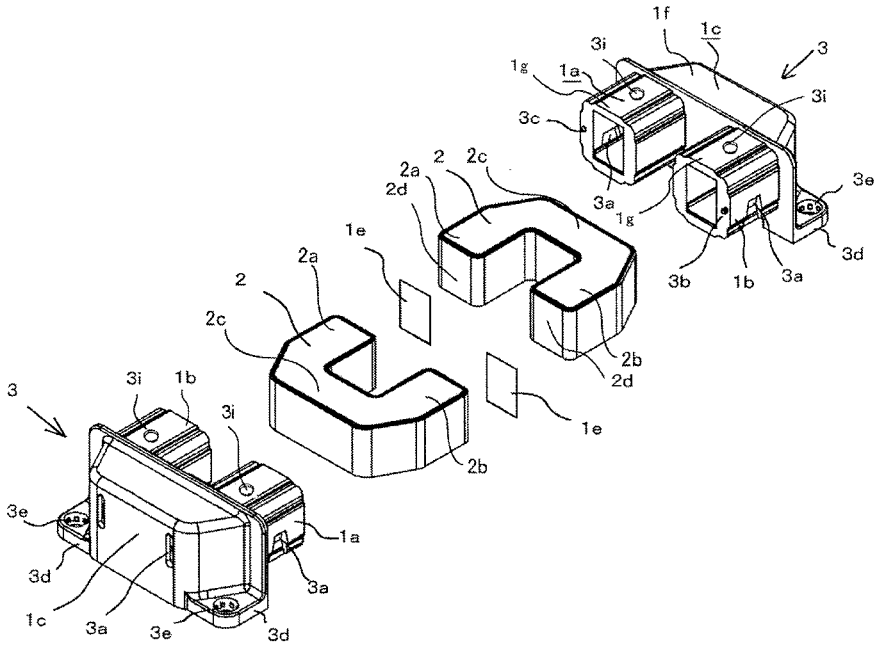
FIG. 2 is an exploded perspective view of the resin-mold core of the first embodiment.

The right and left leg portions 1*a*, 1*b* of the resin-mold core 1 have, in respective end faces, a recess 3*c* and a protrusion 3*b*, respectively, serving as positioning members to coaxially align the opposing leg portions 1*a*, 1*b* when the two U-shaped resin-mold cores 1 are abutted to form an annular shape as illustrated in FIG. 2. In this embodiment, the protrusion 3*b* and the recess 3*c* are a substantially cylindrical protrusion and a circular concavity engaged with the opposing cylindrical protrusion formed on and in the end faces of the mold component 3 exposed at the end faces of the right and left legs 1*a*, 1*b*, but the respective shapes can be changed as needed.

For example, ring-shaped protrusion and groove-shaped recess may be provided so as to encircle the circumference of the magnetic core 2 exposed at the right and left leg portions 1*a*, 1*b*, and a protrusion and a recess may be formed on and in, not the end face of the mold component 3 but the outer circumference thereof along the axial direction of the leg portion.

Formed at the lower part of the mold component 3 forming the yoke portion 1*c* in a substantially trapezoidal shape are a pair of brackets 3*d* so as to extend from the bottom of the yoke portion 1*c* horizontally in the orthogonal direction to the axial direction of the leg portion. Each bracket 3*d* is provided with a bolt insertion hole 3*e* to fasten the whole reactor including the resin-mold core 1 to a casing of the reactor, or a location where the reactor is placed.

(2) Operation and Advantageous Effects

According to the first embodiment employing the above-explained structure, no opening 3*a* is present in a portion where the terminal is drawn from the coil end, i.e., the upper surface 1*f* of the yoke portion 1*c*. Hence, when a reactor is formed using the resin-mold core 1 of this embodiment, an insulation between the magnetic core 2 and the terminal can be sufficiently ensured even if the terminal is disposed at the yoke portion 1*c*.

In order to exclude the opening 3*a* in the upper surface 1*f* of the yoke portion 1*c* like this embodiment, it is necessary not to support the magnetic core 2 set in the die by a member like a protrusion from the upper face side at the time of insert molding. However, by utilizing the weight of the magnetic core 2 itself, the pressure of protrusions supporting the magnetic core 2 in the die from the horizontal direction, or by adjusting the applying speed of the resin filled in the die and the direction thereof, it is possible to suppress a floating of the magnetic core 2 in the die. For example, according to the technology disclosed in JP 2013-074694 A already filed by the Applicant, the resin-mold core 1 having no opening 3*a* in the upper surface 1*f* of the yoke portion 1*c* can be obtained.

According to this embodiment, the resin is filled from the upper space of the resin-mold core 1 to suppress a floating of the magnetic core 2 in the die, and thus a protrusion which holds the magnetic core 2 and located at the upper side thereof becomes unnecessary. Hence, recesses 3*i* that are traces of the filling of the resin are formed in the upper surfaces of the leg portions of the mold component 3.

According to this embodiment, since the protrusion 3*b* and the recess 3*c* are formed on and in the end faces of the right and left leg portions 1*a*, 1*b* of the resin-mold core 1, when the two U-shaped resin-mold cores 1 are abutted annularly, when the protrusion 3*b* and the recess 3*c* are engaged, the opposing leg portions 1*a*, 1*b* can be surely coaxially aligned.

The bolt insertion holes 3*e* to fasten the whole reactor including the resin-mold core 1 are integrally provided in the lower portion of the mold component 3 forming the yoke portion 1*c* in a substantially trapezoidal shape. Accordingly, when performing a molding on the mold component 3 for the magnetic core 2, a fastener of the reactor can be formed simultaneously. Therefore, the number of manufacturing steps of the whole reactor can be reduced.

Since there is no opening 3*a* in the upper surface 1*f* of the yoke portion 1*c*, a work of eliminating burrs to be formed at the edge of the opening 3*a* at the time of molding becomes unnecessary.

2. Second Embodiment

A reactor according to a second embodiment will be explained with reference to FIGS. 3 to 6. The same component as that of the first embodiment will be denoted by the same reference numeral, and the duplicated explanation thereof will be omitted.

(1) Structure

Figure 3:
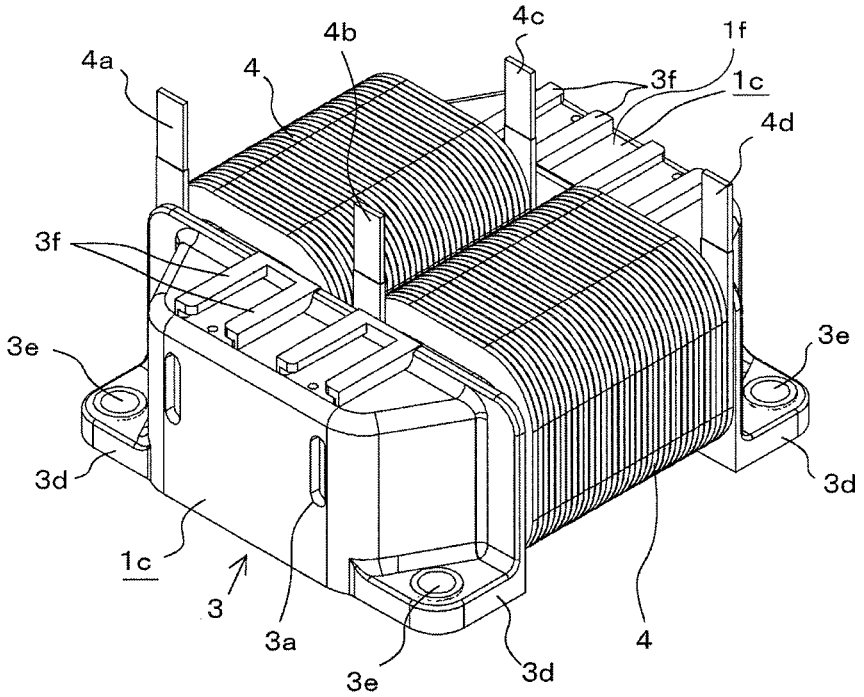
FIG. 3 is a perspective view illustrating a resin-mold core attached with coils according to a second embodiment.
Figure 4:
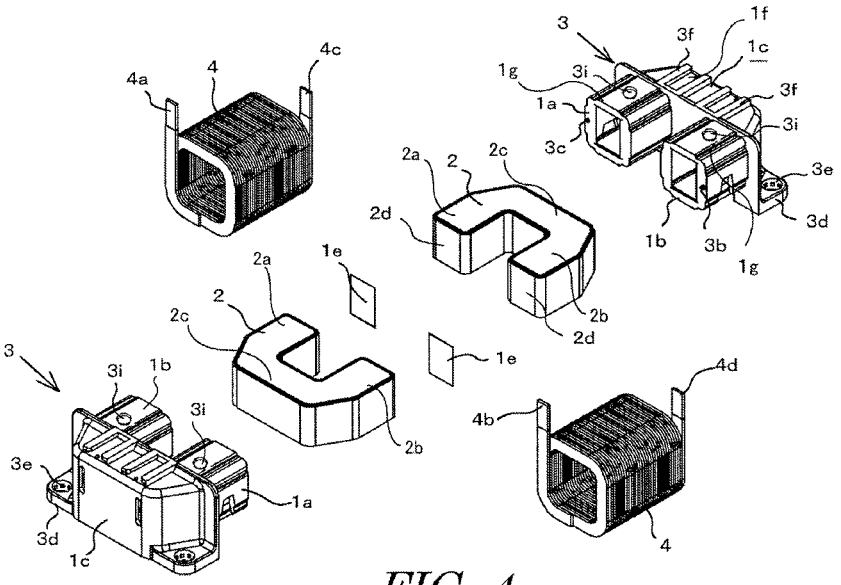
FIG. 4 is an exploded perspective view of the resin-mold core of the second embodiment.

As illustrated in FIGS. 3 and 4, a reactor of this embodiment has two divided resin-mold cores 1 of the first embodiment combined to form an annular-shaped resin-mold core. Coils 4 are attached around the outer circumferences of the leg portions, and terminals 5*a* to 5*d* to electrically connect the coil ends to a component outside of the reactor are provided.

That is, the coils 4 are attached to the respective outer circumferences of the right and left leg portions 1*a*, 1*b* of the resin-mold core 1. The coil 4 has a rectangular wire wound so as to be laminated in the thickness direction, and tabular both ends 4*a* to 4*d* of the respective coils 4 protrude to the upper space beyond the yoke portion surface of the resin-mold core 1 near the end faces of the leg portions 1*a*, 1*b*.

Provided on the upper surface 1*f* of the yoke portion 1*c* in the resin-mold core 1 are fasteners 3*f* to fasten terminals to the resin-mold core 1. The fasteners 3*f* are formed integrally with the upper surface 1*f* of the yoke portion 1*c* of the mold component 3 at the time of molding of the resin-mold core 1. In this embodiment, the fastener 3*f* has two linear protrusions having tips bent like a hook and formed in parallel with each other along the axial direction of the leg portions 1*a*, 1*b* with a clearance matching the width of the terminal maintained therebetween so that the bent tips face with each other.

Figure 5:
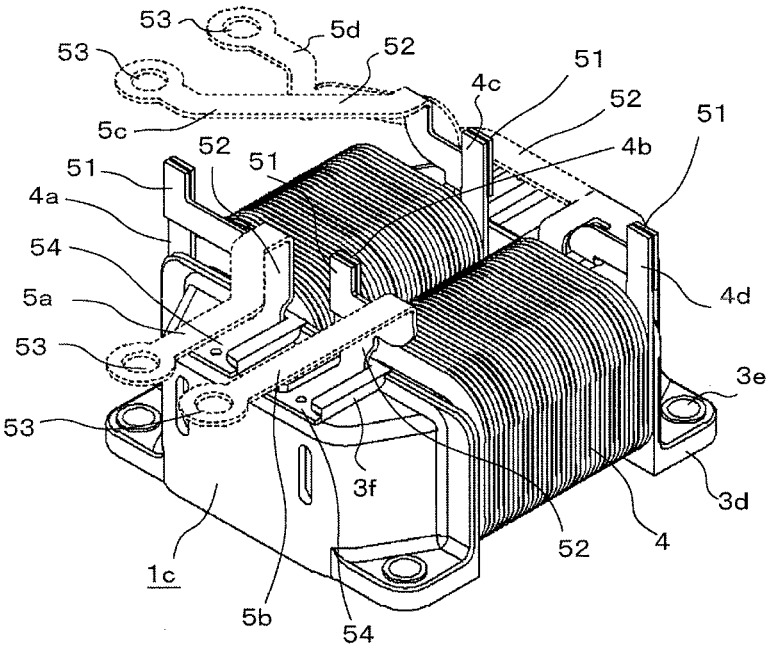
FIG. 5 is a perspective view as viewed from the front of a reactor using the resin-mold core of the second embodiment.
Figure 6:
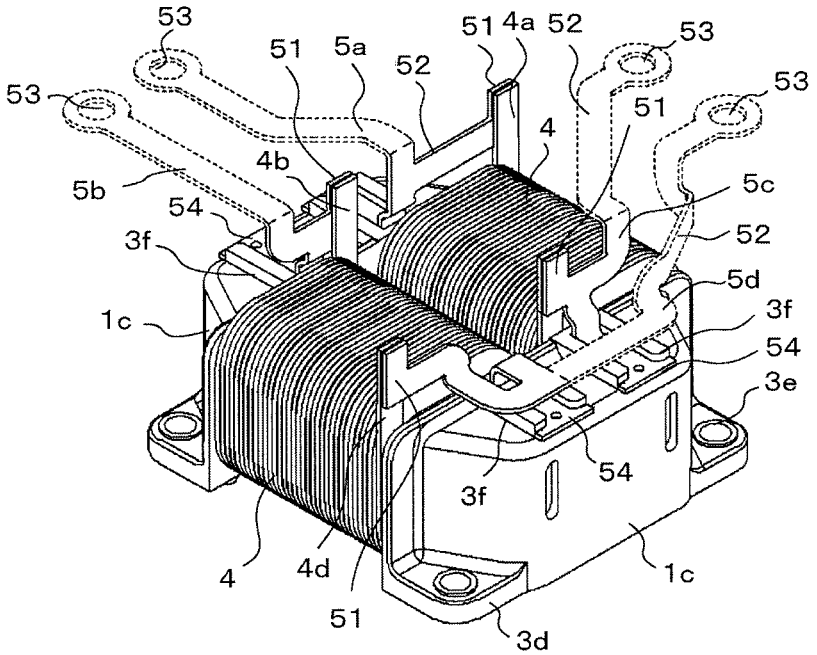
FIG. 6 is a perspective view as viewed from the rear of the reactor using the resin-mold core of the second embodiment.

FIGS. 5 and 6 are each a perspective view illustrating a condition in which terminals 5*a* to 5*d* to be drawn to the exterior and fastened to the fasteners 3*f* of the mold component 3 are connected to both end terminals 4*a* to 4*d* of the respective coils 4. The terminals 5*a* to 5*d* are each formed of a plate-shaped member bent in accordance with the direction in which each terminal 5*a* to 5*d* is to be drawn so as to have a different shape, but commonly have the following three features.

(1) A coil connecting portion 51 lifted up vertically from the surface of the yoke portion 1*c*, and joined with each of the ends 4*a* to 4*d* also lifted up vertically from the surface of the yoke portion 1*c* so as to be superimposed with each other.

(2) A drawn portion 52 horizontally protruding from the coil connection portion 51 toward the exterior of the reactor, and a connection hole 53 provided at the tip of the drawn portion for a connection with an external device.

(3) A fastened portion 54 connected to the lower portion of the coil connecting portion 51, and protruding horizontally from the end of the coil 4 toward the exterior of the yoke portion 1*c* (opposite side to the coil 4) by what corresponds to the thickness of the leg portion at the yoke portion 1*c* in the axial direction.

Among those portions, the fastened portion 54 is fitted in the fastener 3*f* formed on the upper face of the yoke portion 1*c*, and is inserted between the two linear protrusions with a hook-like cross-section toward the coil 4 from the external side of the yoke portion 1*c*. When both side edges of the fastened portion 54 are engaged with the hook portions provided at the respective tips of the two linear protrusions forming the fastener 3*f*, each terminal 5*a* to 5*d* is engaged with the upper face of the yoke portion 1*c*.

In the respective terminals 5*a* to 5*d*, the first and second terminals 5*a*, 5*b* located at the one end sides of the coils 4 have the respective drawn portions 52 disposed across the upper face of the yoke portion 1*c* in parallel with the fastened portion 54. The third terminal 5*d* located at the other end side of the coil 4 is disposed across the whole width of the upper face of the yoke portion 1*c* so as to be orthogonal to the axial direction of the leg portion, and is drawn to the exterior of the reactor in the orthogonal direction to the leg portions 1*a*, 1*b* near the end side of the coil 4. The fourth terminal 5*c* located at the other end side of the coil 4 is bent toward the coil 4 unlike the other terminals, and is drawn to the exterior of the reactor from the substantial center of the coil.

(2) Operation and Advantageous Effects

According to the reactor of this embodiment, since the resin-mold core 1 having no opening in the upper surface 1*f* of the yoke portion 1*c* is utilized, an insulation between the terminals 5*a* to 5*d* and the magnetic core 2 in the mold component can be sufficiently ensured even if the terminals 5*a* to 5*d* are disposed on the upper surface 1*f* of the yoke portion 1*c*. Hence, when the fasteners 3*f* are formed integrally with the upper surface 1*f* of the yoke portion 1*c*, and the terminals 5*a* to 5*d* are fastened at those portions, there is no problem in the insulation. As a result, the respective terminals 5*a* to 5*d* can be fastened by a simple scheme that is to integrally provide the fasteners 3*f* with the mold component of the resin-mold core 1.

In particular, in production of the reactor, in addition to the core component, coils, terminals, an insulation member, fasteners, etc., are necessary, but the optimization of the respective combinations is quite difficult. As a result, according to the conventional technologies, there are various problems, such as an increase in the size of the reactor, an occurrence of a dead space, and an increase in the number of components. In contrast, according to this embodiment, respective members, such as the magnetic core 2 and the mold component 3 are molded together, and at this time, the bolt insertion holes 3*e* to fasten the whole reactor, the fasteners 3*f* of the terminals, and the protrusion 3*b* and the recess 3*c* for positioning of the two U-shaped cores, are formed integrally with the mold component 3. Accordingly, the components to form the reactor can be collectively provided in the resin-mold core 1 as much as possible.

As a result, according to this embodiment, duplicated function and shape when components are provided individually can be eliminated, and the number of components can be remarkably reduced. Therefore, the assembling of the reactor can be simplified and the costs thereof can be reduced.

In this embodiment, the coils 4 each formed of a wound rectangular wire is utilized, and tabular both ends 4*a* to 4*d* are lifted up beyond the yoke portion surface of the resin-mold core 1. Moreover, the coil connecting portions 51 are lifted up vertically from the surface of the yoke portion 1*c*, and the plate-shaped end of the coil connecting portion are joined together to connect the coil 4 and each terminal 5*a* to 5*d*. Hence, the tabular coil ends 4*a* to 4*d* and the respective terminals 5*a* to 5*d* can be positioned by simply sliding the terminals 5*a* to 5*d* in the axial direction of the leg portion from the exterior of the yoke portion 1*c*, and fitting those in the fasteners 3*f*, and thus the joining work of the coil ends with the respective terminals can be facilitated.

According to this embodiment, also, the protrusion 3*b* and the recess 3*c* are formed on and in the end faces of the right and left leg portions 1*a*, 1*b* in the resin-mold core 1. Hence, when the two U-shaped resin-mold cores 1 are abutted annularly, the opposing leg portions 1*a*, 1*b* can be precisely aligned coaxially by fitting those protrusion 3*b* and recess 3*c*.

3. Third Embodiment

A reactor of a third embodiment will be explained with reference to FIGS. 7 to 14. The similar component to that of the first embodiment will be denoted by the same reference numeral, and the duplicated explanation thereof will be omitted. According to this embodiment, the terminals 5*a* to 5*d* are molded in a resin-made terminal stage 6, and the terminal stage 6 and the resin-mold core 1 are fastened together to connect the coil ends 4*a* to 4*d* with the terminals 5*a* to 5*d*.

Figure 7:
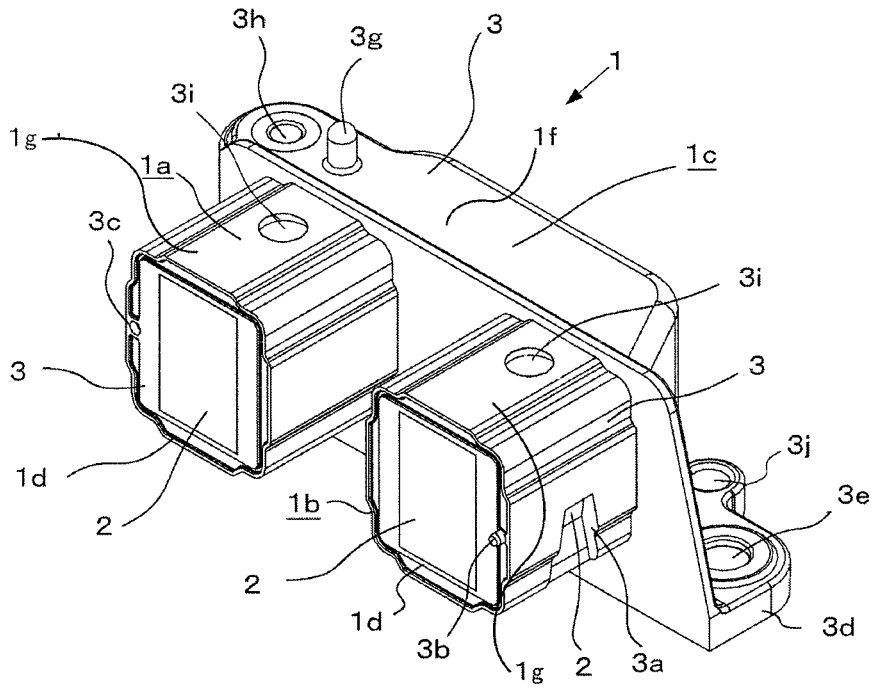
FIG. 7 is a perspective view of a resin-mold core according to a third embodiment.
Figure 8:
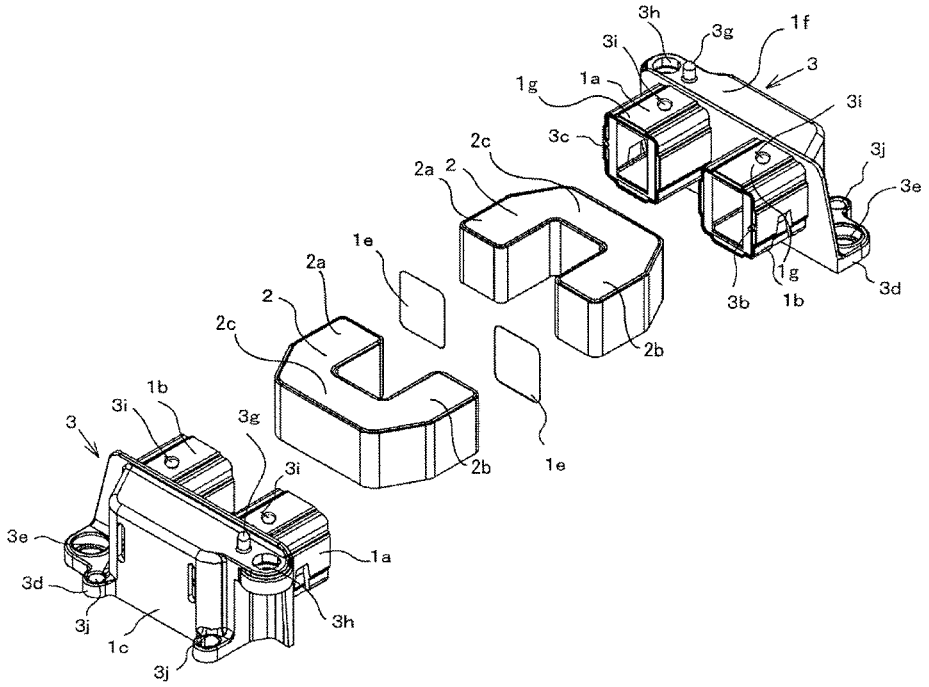
FIG. 8 is an exploded perspective view of the resin-mold core of the third embodiment.
Figure 9:
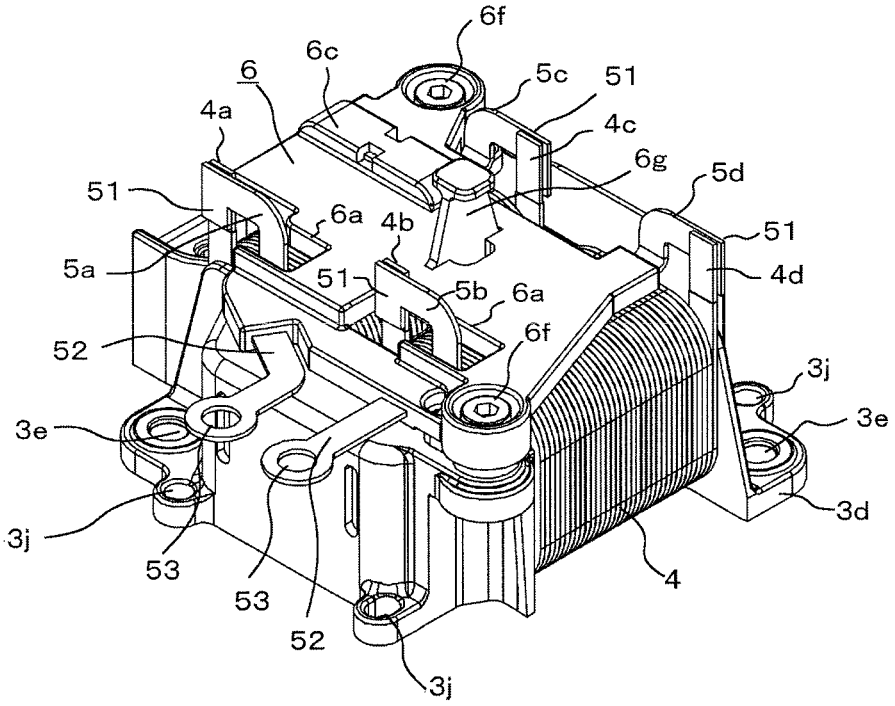
FIG. 9 is a perspective view as viewed from the front of the reactor using the resin-mold core of the third embodiment.
Figure 10:
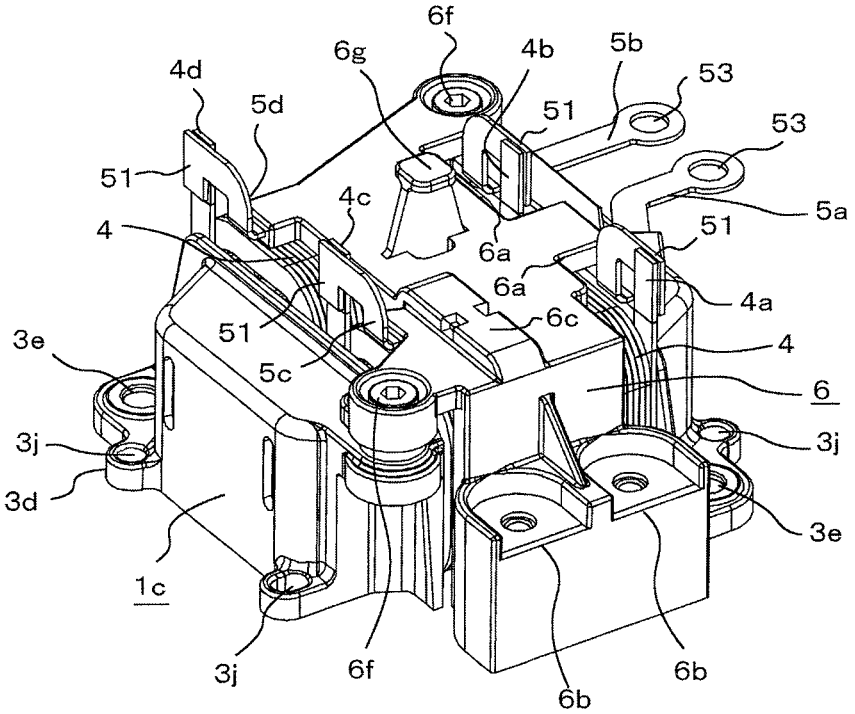
FIG. 10 is a perspective view as viewed from the rear of the reactor using the resin-mold core of the third embodiment.
Figure 11:
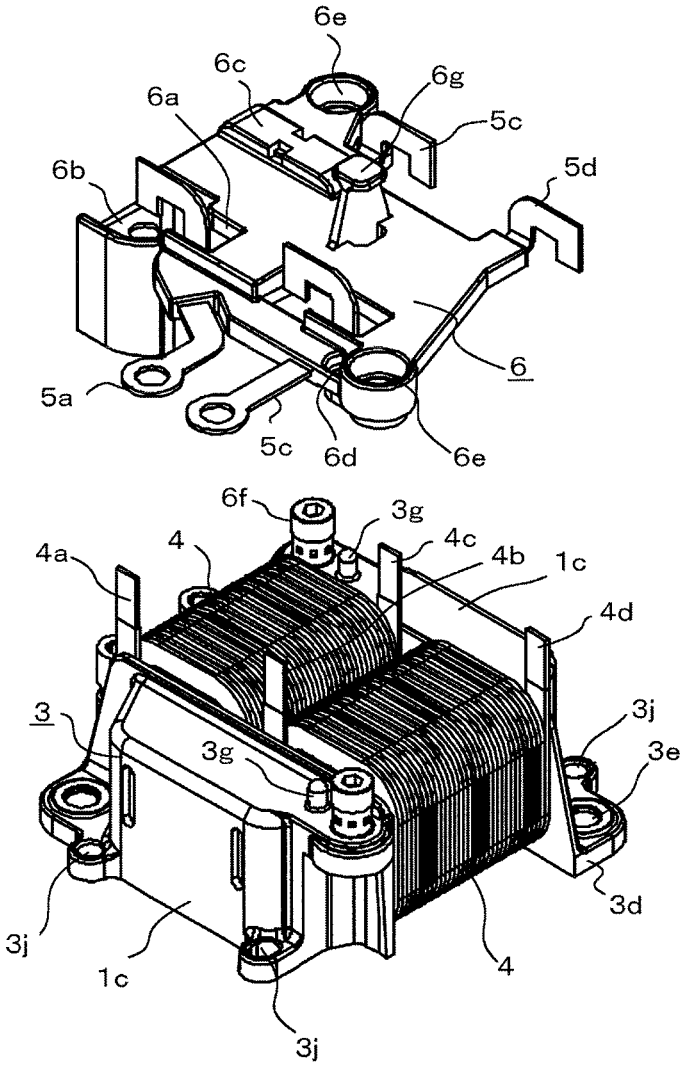
FIG. 11 is an exploded perspective view illustrating a relationship among a terminal stage, the resin-mold core and coils as viewed from the front according to the third embodiment.
Figure 12:
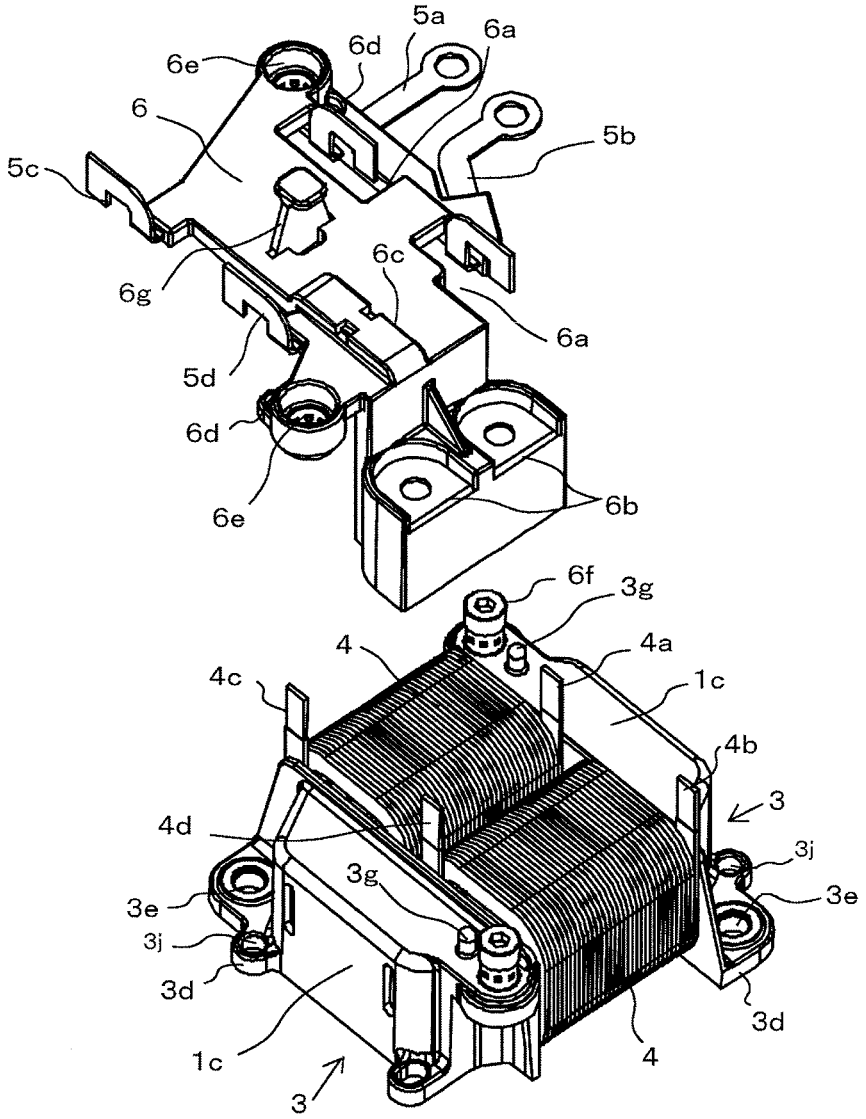
FIG. 12 is an exploded perspective view illustrating a relationship among the terminal stage, the resin-mold core, and the coils as viewed from the rear according to the third embodiment.

The resin-mold core 1 utilized in this embodiment basically employs the same structure as that of the resin-mold core 1 of the first embodiment, but as illustrated in FIGS. 7 and 8, a protrusion 3*g* for positioning the terminal stage 6, and a screw hole 3*h* near the protrusion 3*g* and to fasten the terminal stage 6 to the resin-mold core 1 are provided on and in a side of the upper face of the yoke portion 1*c*.

The pair of brackets 3*d* are formed at the lower part of the resin-mold core 1 so as to extend horizontally toward the orthogonal direction to the axial direction of the leg portion from the bottom of the yoke portion 1*c* like the second embodiment. In this embodiment, the first bracket 3*d* is provided with the bolt insertion hole 3*e* to fasten the whole reactor including the resin-mold core 1 to the casing of the reactor or the location where the reactor is placed, and a hole 3*j* where a positioning protrusion (unillustrated) provided on the casing or the location where the reactor is placed is fitted in. The second bracket 3*d* is provided with only the hole 3*j* where the positioning protrusion is fitted in. As a result, when the two U-shaped resin-mold cores 1 are combined annularly and a reactor is formed, the reactor can be fastened to the casing or that location by simply fitting bolts in the bolt insertion holes 3*e* provided in the two diagonal locations.

The terminal stage 6 is a substantially plate-shaped member covering the two yoke portions 1*c* opposite to each other and the two coils 4, 4 located therebetween, and a part of each of four terminals 5*a* to 5*d* is embedded in the resin forming the terminal stage 6 by insert molding. That is, in this embodiment, the terminals 5*a* to 5*d* are each formed of a plate-shaped member bent in a different shape in accordance with the drawn direction, but all have the following two features.

(1) Coil connecting portion 51 lifted up vertically from the surface of the yoke portion 1*c*, and is superimposed with each coil end 4*a* to 4*d* also vertically lifted up from the surface of the yoke portion 1*c*.

(2) Drawn portion 52 protruding horizontally from the coil connection portion 51 toward the exterior of the reactor, and connection hole 53 provided at the tip of the drawn portion for a connection with an external device.

Those terminals 5*a* to 5*d* are integrated with the terminal stage 6 by burring a part of each drawn portion 52 other than the coil connecting portions 51 at both ends and the connection holes 53 for the external device in the terminal 6 by insert molding.

Figure 13:
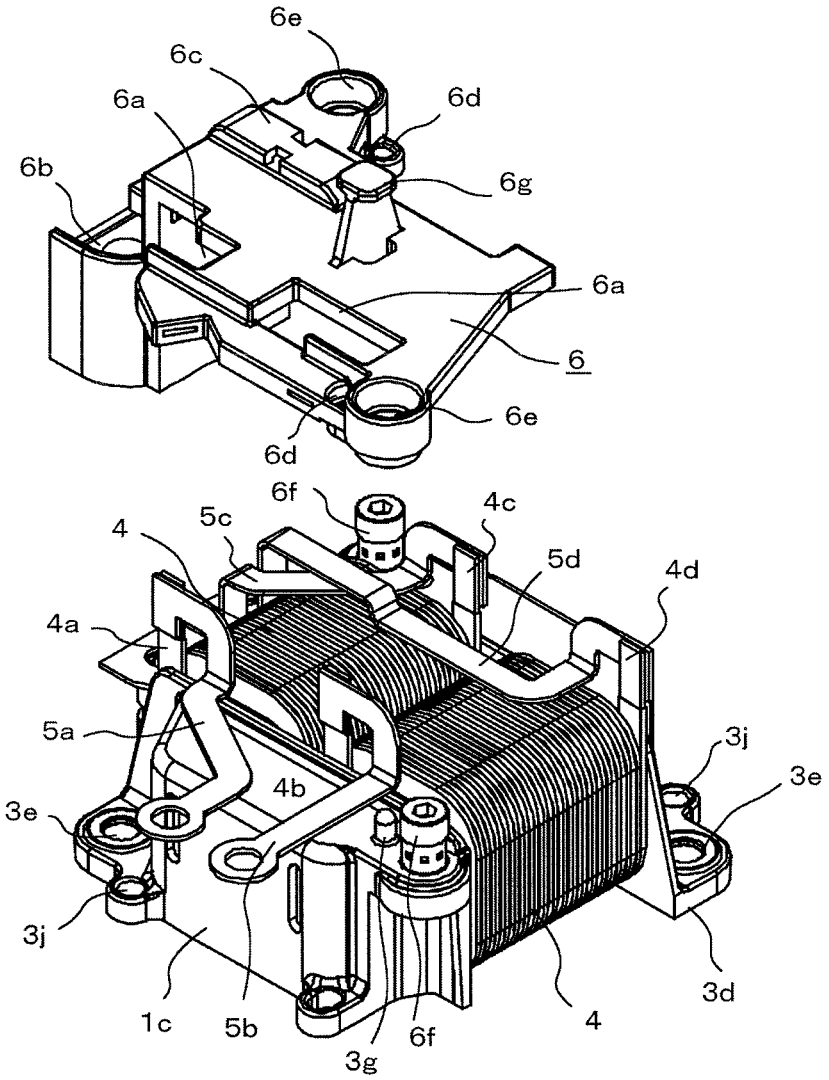
FIG. 13 is an exploded perspective view illustrating connecting relationship between a coil end and a terminal as viewed from the front according to the third embodiment.
Figure 14:
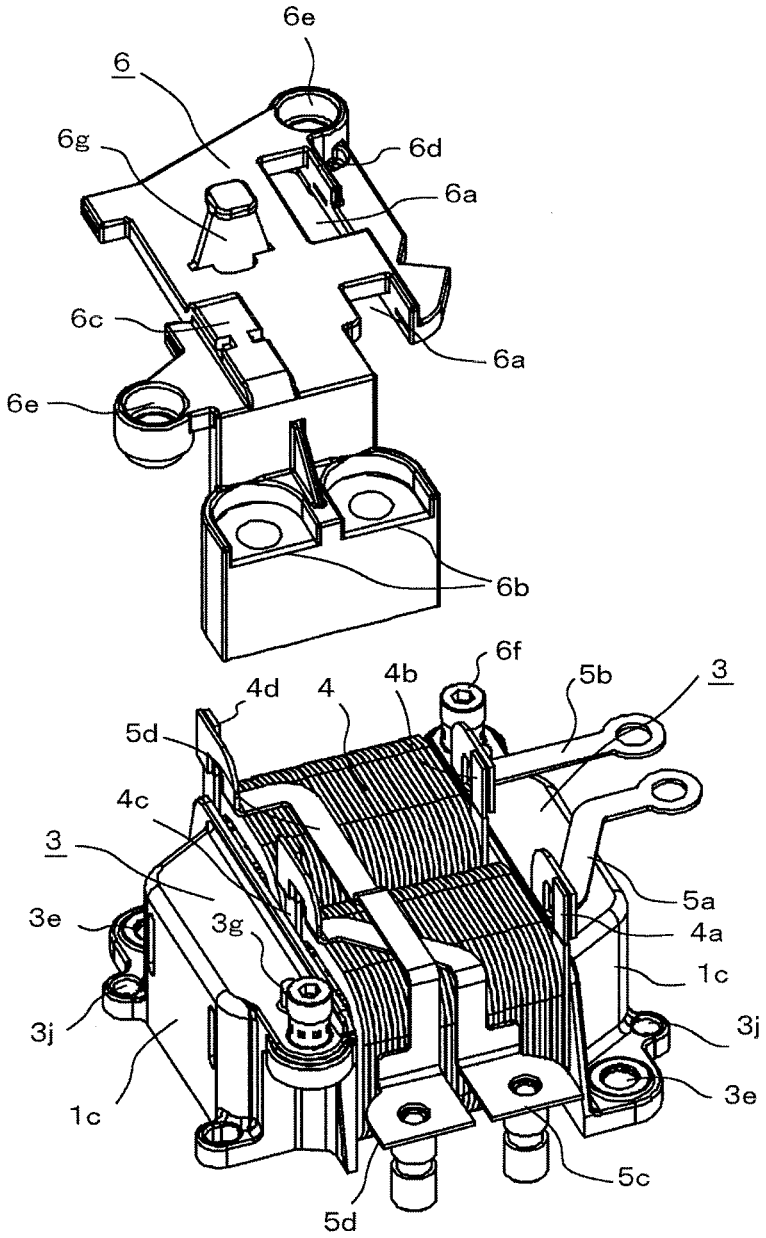
FIG. 14 is an exploded perspective view illustrating a connection relationship between the coil end and the terminal as viewed from the rear according to the third embodiment.
Figure 15:
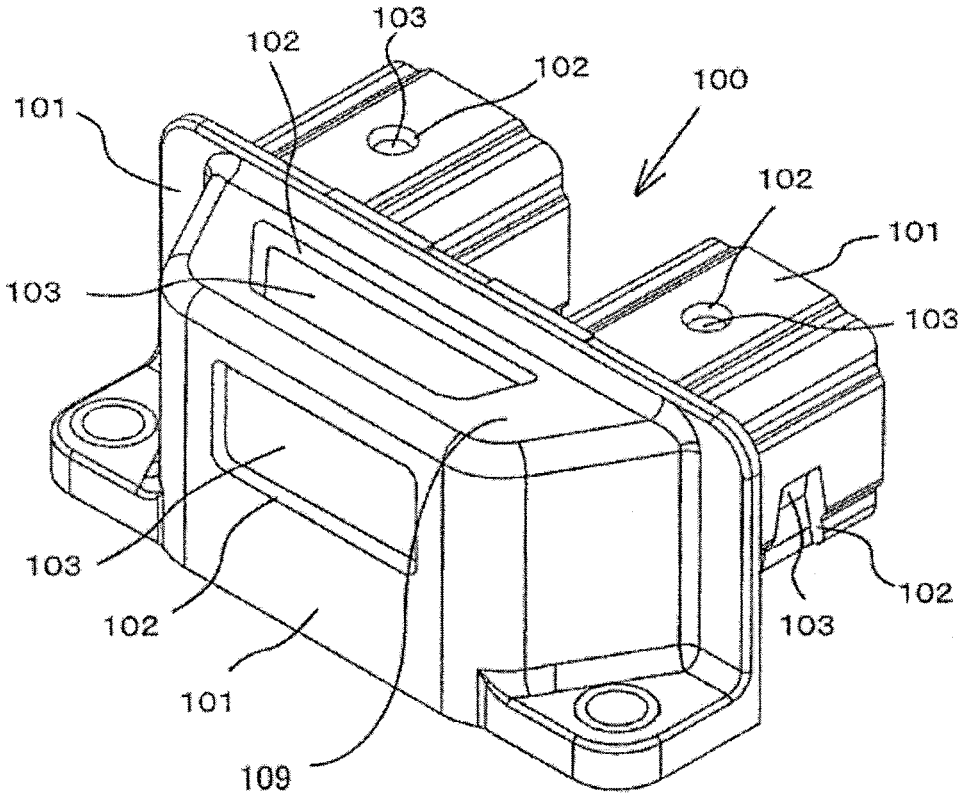
FIG. 15 PRIOR ART
FIG. 15 is a perspective view illustrating an example conventional resin-mold core.

As illustrated in FIGS. 13 and 14, in the respective terminals 5*a* to 5*d*, the first and second terminals 5*a*, 5*b* located at the one end sides of the coils 4 have the respective drawn portions 52 in parallel with the respective fastened portions 54 across the upper face of the yoke portion 1*c*. In addition, two openings 6*a* are formed in the terminal stage 6 along the yoke portion 1*c*, and the coil connecting portions 51 of the terminals 5*a*, 5*b* lifted up from the respective drawn portions 52 are fitted in the respective two openings 6*a*. When the terminal stage 6 is fastened to the resin-mold core 1, the ends 4*a*, 4*b* of the two coils are fitted in such openings 6*a*, and the respective coil connecting portions 51 of the terminals 5*a*, 5*b*, and the respective coil ends 4*a*, 4*b* are superimposed.

The third and fourth terminals 5*c*, 5*d* located at the other end sides of the coils 4 are bent toward the coils 4 opposite to the yoke portion 1*c*, and drawn to the exterior of the reactor from the substantial center of the coils. Hence, two catches 6*b* to hold the connection holes 53 provided at the tips of the terminals 5*c*, 5*d* are provided at a side of the coil 4 in the terminal stage 6 so as to adjoin with each other. In this embodiment, the drawn portions 52 of the two terminals 5*c*, 5*d* intersect with each other above the coil 4, and thus the terminal stage 6 where the two terminals 5*c*, 5*d* are embedded is formed with a thicker portion 6*c* that ensures an insulation distance at the intersecting portion.

Provided at two diagonal corners of the terminal stage 6 are a recess 6*d* with which the positioning protrusion 3*g* is engaged, and a screw insertion hole 6*e* corresponding to the positioning protrusion 3*g* and the screw hole 3*h* for fastening both provided at the yoke portion 1*c*. With the protrusion 3*g* and the recess 6*d* being engaged for positioning, the screw hole 3*h* and the screw insertion hole 6*e* are aligned, and a fastening screw 6*f* is fitted therein, and thus the terminal stage 6 is fastened to the resin-mold core 1.

A handle 6*g* to carry an assembled reactor with the terminal stage 6 fastened to the resin-mold core 1 is formed integrally at the center of the terminal stage 6. The handle 6*g*, the recess 6*d*, the screw insertion hole 6*e*, the thicker portion 6*c*, and the two caches 6*b* are all formed simultaneously when molding the terminals 5*a* to 5*d* in the terminal stage 6.

(2) Operation and Advantageous Effects

According to this embodiment, the four terminals 5*a* to 5*d* are integrated with the one terminal stage 6 by molding, and the terminal stage 6 is fastened to the two U-shaped resin-mold cores 1 assembled annularly so as to cover the assembled cores. Through such a simple work, the fastening of the terminals 5*a* to 5*d* to the resin-mold cores can be easily carried out. In particular, since the terminal stage 6 and the yoke portion 1*c* are provided with positioning recess 6*d* and protrusion 3*g*, respectively, when both are engaged with each other, the terminal stage 6 and the yoke portion 1*c* can be precisely positioned.

According to this embodiment, like the first embodiment, the yoke portion 1*c* has no opening where the magnetic core 2 is exposed. Hence, even if the terminals 5*a* to 5*d* are disposed on the upper face of the yoke portion 1*c*, a sufficient insulation is ensured. In addition, the respective drawn portions 51 of the terminals are embedded in the resin-made terminal stage 6, and thus the mold component 3 at the resin-mold-core-1 side and the resin-made terminal stage 6 ensures the insulation. Hence, an excellent insulation performance can be accomplished. Because of the improvement of the insulation performance by the mold component 3 and the terminal stage 6, the drawing direction of the terminals 5*a* to 5*d* can be freely selected, and thus the designing of the reactor is facilitated, and reduction of the reactor disposing space can be enabled.

According to this embodiment, the coil 4 formed of a wound rectangular wire is utilized, the tabular ends 4*a* to 4*d* are lifted upwardly beyond the surface of the yoke portion of the resin-mold core 1, and the coil connecting portions 51 of the respective terminals embedded in the terminal stage 6 are also lifted vertically from the surface of the yoke portion 1*c*. The tabular coil ends and the respective terminals are joined together, thereby connecting the coils 4 and the respective terminals 5*a* to 5*d*. Accordingly, by a simple sliding work of the terminal stage 6 to the yoke portion 1*c* from the upper space, the coil ends 4*a* to 4*d* and the respective terminals 5*a* to 5*d* can be superimposed with each other, and thus the joining work of the coil ends with the respective terminals can be facilitated.

Since the terminal stage 6 is integrally provided with the handle 6*g*, even if the location where the reactor is to be placed is surrounded on all four sides by walls and it is difficult to set the reactor while holding the outer periphery thereof, the reactor can be carried and installed from the upper space of that location by utilizing the handle 6*g* at the upper face of the terminal stage 6.

According to this embodiment, also, the protrusion 3*b* and the recess 3*c* are formed on and in the end faces of the right and left leg portions 1*a*, 1*b* in the resin-mold core 1, when the two U-shaped resin-mold cores 1 are abutted annularly, if those protrusion 3*b* and recess 3*c* are engaged with each other, the opposing leg portions 1*a*, 1*b* can be precisely aligned coaxially.

Still further, according to this embodiment, like the first and second embodiments, the magnetic core 2 is molded in the mold component 3, and at this time, respective components, such as the bolt insertion holes 3*e* to fasten the whole reactor, the fasteners 3*f* for the terminals, and the protrusion 3*b* and recess 3*c* for positioning of the two U-shaped cores, can be formed integrally with the mold component 3. Hence, the component of the reactor can be collectively provided in the resin-mold core 1 as much as possible.

4. Other Embodiments

The present disclosure is not limited to the aforementioned embodiments, and other embodiments explained below are also possible.

(1) The resin-mold core is not limited to the U-shape, and the present disclosure is applicable to a resin-mold core having equal to or greater than three leg portions like an E-shaped core.

(2) As the magnetic core, one that is a combination of the two U-shaped cores, or one that is a combination of the two U-shaped cores and multiple I-shaped cores annularly may be applicable. In this case, the I-shaped core may be molded in the mold component, or a cylindrical bobbin may be formed integrally with an end portion of the mold component covering the outer circumference of the U-shaped core, and the I-shaped core may be fitted in the bobbin.

(3) The resin-mold core of the present disclosure is not limited to a single U-shaped core in FIG. 1, but the magnetic core 2 molded annularly beforehand or the magnetic core 2 that is a combination of the two U-shaped cores annularly may be set in the die, and the mold component 3 may be formed around the set magnetic core by molding.

(4) At least one of the terminals drawn from the coil ends needs to be disposed on the upper face of the yoke portion 1*c* where no opening 3*a* is present, but the wiring direction of the other terminals can be in the axial direction of the coil or an orthogonal direction to the axial direction.

(5) It is not necessary that the number of the terminal stage 6 be one, but the terminal stage may be divided into multiple pieces in the axial direction of the leg portion and the orthogonal direction thereof, and the terminals may be molded in each divided piece two by two. In this case, like the second embodiment, fasteners along the axial direction of the leg portion may be provided on the yoke portion 1*c*, and the two pieces of the terminal stage 6 may be slid to hold the resin-mold core 1 from both sides and engaged with the fasteners to fasten the terminal stage 6 with the resin-mold core.

(6) It is not necessary that the terminal stage 6 cover the portion of coil 4, and may cover only the upper face of the yoke portion. In addition, the terminal stage 6 may be provided on the one yoke portion of the annular core.

What is claimed is:

1. A resin-mold core comprising:

two divisional magnetic cores having a plurality of leg portions and a yoke portion which connects the leg portions;

two divisional resin-mold components having a plurality of leg portions and a yoke portion which connects the leg portions, and having the two divisional magnetic cores respectively embedded inside by mold-forming;

a coil is mounted around at least one of the leg portions of the two divisional resin-mold components;

a terminal is connected to the coil;

openings formed on a plurality of surfaces of the divisional resin-mold components except for a portion of the yoke portions of divisional resin-mold components from which the coil is drawn out to an exterior;

a resin-made terminal stage is fixed to the yoke portion of the divisional resin-mold components; and a fixing member fixing the terminal stage to the divisional resin-mold components in a way that the terminal stage covers the yoke portion of the divisional resin-mold components from above the yoke portion, wherein the terminal is embedded in the terminal stage by mold-forming and is connected to an end portion of the coil.

2. The resin-mold core according to claim 1, further comprising:

a positioning member provided at the yoke portions of the divisional resin-mold components and horizontally positioning the yoke portion and the terminal stage covering the yoke portion from above the yoke portion.

3. A reactor comprising:

the resin-mold core according to claim 1;

coils mounted around the leg portions of the resin-mold component; and the terminal for leading out to the exterior, the terminal being drawn to an exterior from the portion of the yoke portion of the divisional resin-mold components where the openings are not provided.

4. The reactor according to claim 3, wherein the terminal stage covers the surface of the yoke portion of the divisional resin-mold components from above the yoke portion so that the terminal stage is fixed to the resin-mold component.

5. The reactor according to claim 4, wherein the terminal stage is one member covering partially or all of the yoke portions of the two U-shaped divisional resin-mold components and the coils mounted around the right and left leg portions of the divisional resin-mold components, and four terminals, connected to both end portions of each of the coils, are embedded in the one terminal stage by mold-forming.

6. A reactor comprising:

an annular shaped resin mold core with a plurality of leg portions connected to yoke portions attached at each end of the leg portions and embedded in a two dimensional resin-mold component;

coils are attached to leg portions of the two divisional resin-mold components: and a resin-made terminal stage is positioned above the coils and fastened to the coil ends with terminals embedded in the resin-made terminal stage for insulation and extending above the resin-made terminal stage to enable exterior connections to the coils;

a fixing member fixing the terminal stage to the divisional resin-mold components, wherein the terminal stage covers the yoke portion of the divisional resin-mold components from above the yoke portion of the resin mold core; and wherein recesses are provided in the resin-made terminal stage adjacent positioning protrusions extending upward from the divisional resin-mold components to enable an alignment of screw holes for receiving fastening screws to fasten the divisional resin-mold components to the resin-made terminal stage.

7. The reactor according to claim 6 wherein the resin-made terminal stage is provided with a handle extending upward from the resin-made terminal stage.

8. The reactor according to claim 6 wherein the resin-made terminal stage is a substantially plate-shaped member covering two yoke portions of the divisional resin-mold components, two coils and a part of the terminals that are connected to the coils and extend vertically upward from the yoke portions of the divisional resin-mold components to be superimposed with coil ends through openings in the resin-made terminal stage.

* * * * *